United States Patent [19]

Druge et al.

[11] 4,047,414

[45] Sept. 13, 1977

[54] BEARING RACE ROLLING DEVICE

[75] Inventors: Gérard Druge; Roger Troccaz, both of Annecy, France

[73] Assignee: Societe Nouvelle de Roulements, Annecy, France

[21] Appl. No.: 739,014

[22] Filed: Nov. 4, 1976

[30] Foreign Application Priority Data

Nov. 6, 1975 France ..... 75.33940

[51] Int. Cl.[2] ..... B21H 1/12

[52] U.S. Cl. ..... 72/91; 72/105; 72/107; 72/110

[58] Field of Search ..... 72/91, 105, 106, 107, 72/110; 29/148.4 R

[56] References Cited

U.S. PATENT DOCUMENTS 3,382,693 5/1968 Rozhdestvensky ..... 29/148.4 R
3,822,574 7/1974 Krupin et al. ..... 72/110
3,855,833 12/1974 Connell ..... 72/91

*Primary Examiner*—Lowell A. Larson
*Attorney, Agent, or Firm*—Fleit & Jacobson

[57] ABSTRACT

Device for rolling rolling-contact bearing races from a blank by means of a die and shaping wheels comprising an inner roller for obtaining the internal profile of the race in the die from which it is separated to permit a possible extrusion of the excess material of said blank, and an outer wheel for shaping part of the external profile of the race against the action of the inner roller, said die being divided in the axial direction into two separable sections disposed on either side of said outer wheel in a die support and constituting a cavity of which the profile is designed for shaping the portions of the outer profile of the race which are adjacent to those shaped by said roller, the two die sections being fitted for free rotation in said die support.

6 Claims, 3 Drawing Figures

21
12
15
18
8b
18
16
17
2b
8a
22
1
19
22
2a
5a
6
3a
10
3b
7
5b

BEARING RACE ROLLING DEVICE

This invention relates in general to means for rolling bearing races from blanks by using a die and wheels, said wheels comprising an internal roller for obtaining the inner profile of the race in the die from which it is separated to permit a possible extrusion of the excess blank material.

Various rolling devices are already known, notably through the U.S. Pat. No. 3,857,147 and 3,871,204 directed to means for manufacturing bearing races without dimensional tolerances such that only a minor final grinding is necessary to obtain the finished product. As a rule, such devices utilize either a single wheel or roller, or a plurality of them; however, with the structures known in either case it is extremely difficult to obtain the desired extremely reduced tolerance values.

It is the essential object of the present invention to improve considerably rolling devices of this kind and also the results that can be obtained therewith.

Basically, and for this purpose, the improved bearing race rolling device according to this invention, operating on a blank through a die and wheels assembly comprising an inner bore-forming roller, that is, a roller capable of imparting the desired bore profile to the race from which said roller is constantly separated to permit a possible extrusion of the excess blank material, and an outer wheel for imparting the desired profile to the outer surface of the race against, or in contrast to, the action exerted by the inner roller, characterised in that said die is divided in the axial direction into two detachable sections disposed on either side of said outer wheel in a die support, said sections forming between them a cavity, slot or recess having a profile adequate for shaping the portions of the outer race contour which are adjacent to the portions shaped by the wheel, the two successive sections of said die being fitted for loose rotation in said die support.

With this device, it is thus possible to obtain in combination, and very satisfactorily in actual production conditions and also from the standpoint of precision, a rolling action between the wheel and roller, and also a closed-die shaping effect permitting the escape of any excess metal in the form of burrs.

Furthermore, with this rolling device, as will be explained presently, it is also possible to mount the inner roller between a pair of supporting bearings, thus enhancing the precision of the shaping operation.

Other features and advantages of this invention will appear as the following description proceeds with reference to the attached drawing illustrating diagrammatically by way of example a typical embodiment of a rolling device constructed according to the teachings of this invention. In the drawing.

Figure 1:
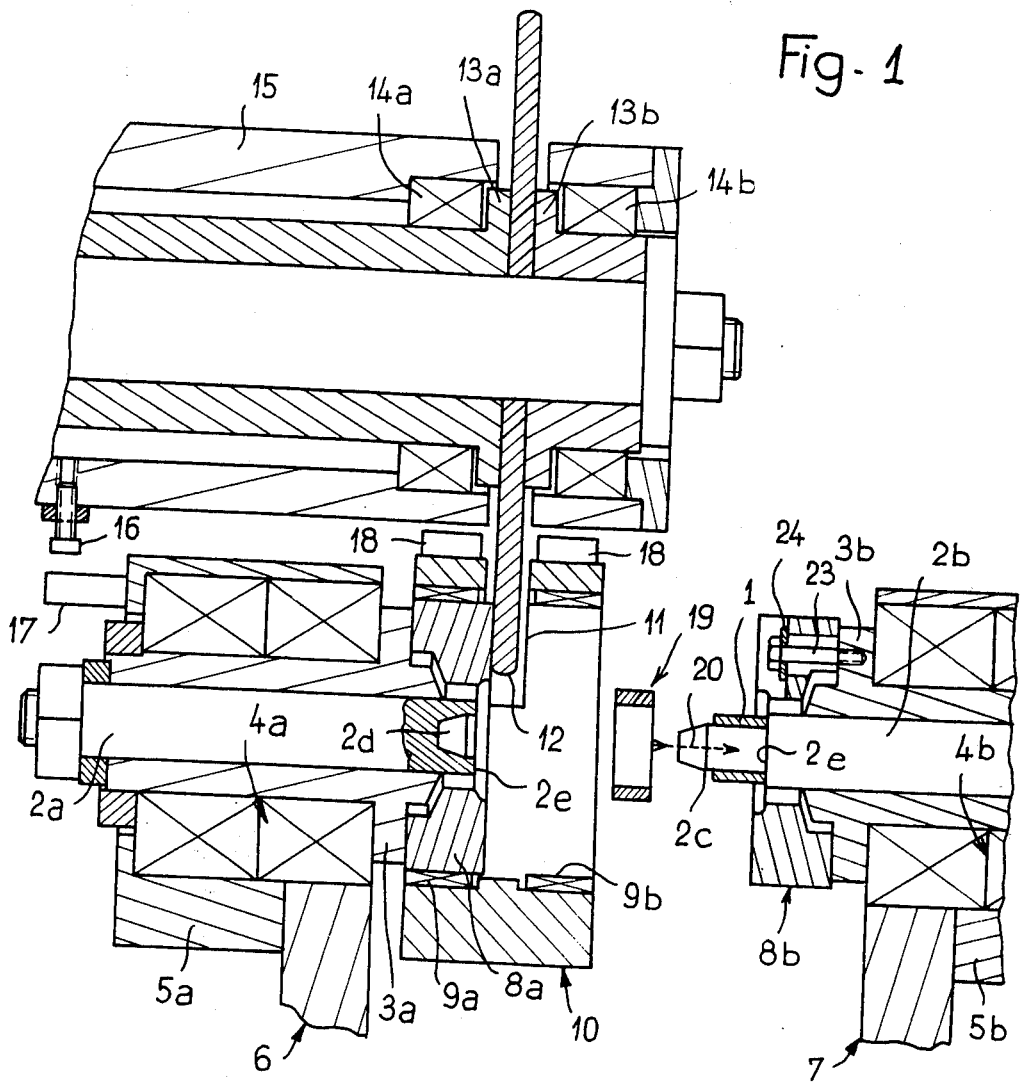
FIG. 1 is an axial section showing the rolling device in its inoperative and feed position, for the manufacture of the inner races of ball-bearings.
Figure 2:
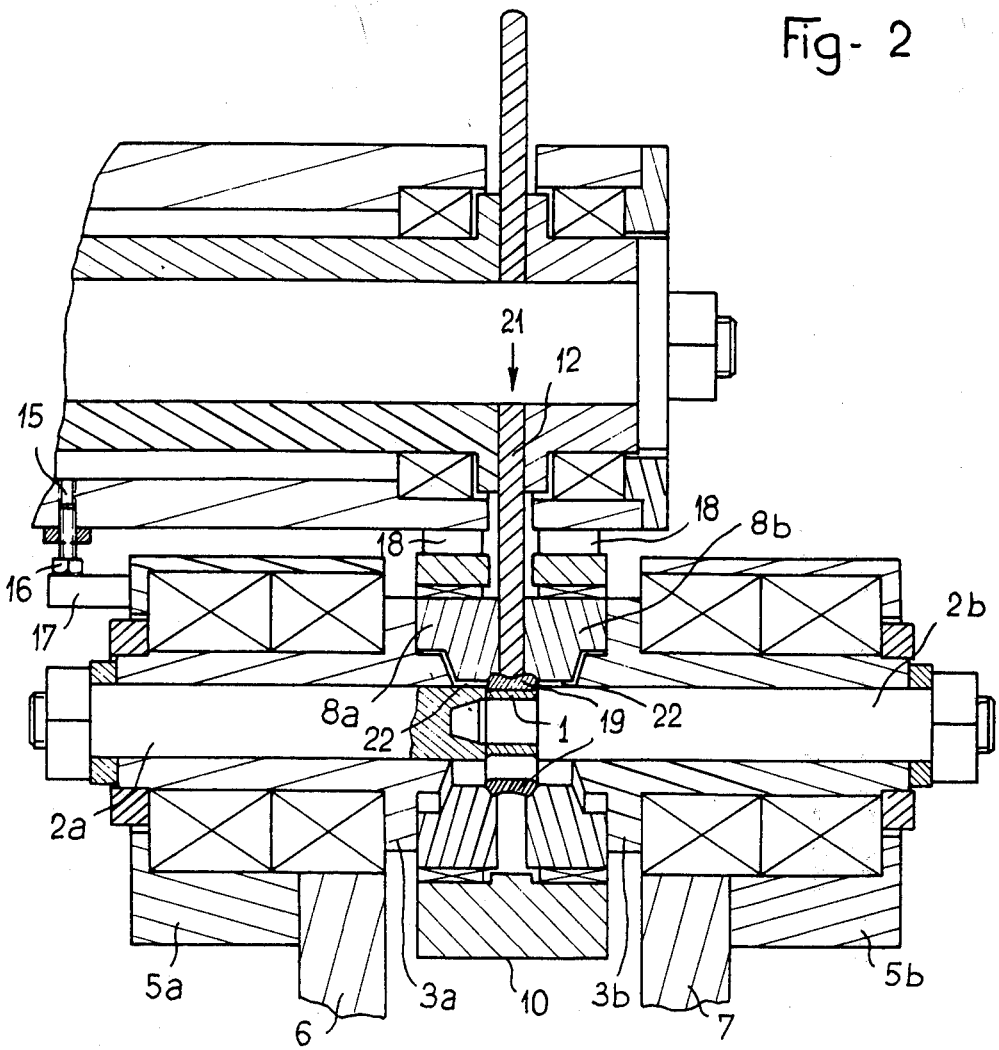
FIG. 2 is a sectional view similar to FIG. 1 showing the same device in its operating position.

The device illustrated in FIGS. 1 and 2 comprises an inner roller 1 carried by a shaft comprising two sections 2*a*, 2*b* adapted to be assembled in end-to-end relationship, the roller 1 being force-fitted, in this example, on a stub extension 2*c* of reduced diameter of shaft section 2*b*, said stub extension 2*c* comprising a tapered end portion and being adapted to engage without play a correspondingly shaped cavity 2*d* formed in the registering end of section 2*a*. The two shaft sections 2*a*, 2*b* further comprise registering shoulders 2*e* for holding the roller 1 in the axial direction when said shaft sections 2*a* and 2*b* are assembled as illustrated in FIG. 2.

The shaft sections 2*a* and 2*b* are mounted in lateral die guide members 3*a*, 3*b* and rotatably mounted therewith in rolling-contact bearings 4*a*, 4*b* mounted in bearing cases 5*a*, 5*b* with case 5*a*, rigid with a fixed bracket or like support 6 and case 5*b*, rigid with another bracket or support 7 movable for axial translation in relation to case 5*a* from the position shown in FIG. 1 to the position shown in FIG. 2, and vice-versa.

Associated with the lateral die guide member 3*a* is a half-die 8*a* mounted for free rotation by means of a rolling-contact bearing 9*a* in a die support 10 consisting essentially of a sleeve carrying another rolling-contact bearing 9*b* adapted to receive the other half-die 8*b* normally associated with the other lateral die guide 3*b*.

The die support 10 has formed intermediate its end a radial slot 11 engageable by an external, outer-race wheel 12 adapted to co-act with the half-die 8*a*, 8*b* in the operative positions thereof, as illustrated in FIG. 2.

The outer wheel 12 is rigid with a rotary driving shaft or spindle and clamped between a pair of flanged sleeves 13*a*, 13*b* mounted in bearings 14*a*, 14*b* fitted in the outer end of a tubular spindle support 15.

This tubular spindle support 15 is movable in a direction across its axis for moving the outer wheel 12 towards the inner roller 1. The amplitude of this movement is adjustable by means of a screw 16 provided with a lock nut and engaging a tapped radial hole formed in the outer wall of tubular spindle 15; this screw 16 is adapted to co-act with an abutment member 17 rigid with the assembly comprising the bearing section 5*a* and the fixed support 6.

During this movement, the spindle support 15 also co-acts with the die support 10 via at least one adjustable mechanical abutment member, in this case a pair of stop members 18 disposed on either side of outer wheel 12 on the die support.

The above-described device operates as follows

In the inoperative and feed condition illustrated in FIG. 1 a blank 19 corresponding to the desired bearing race is placed on the inner roller as illustrated by the arrow 20, for instance with the assistance of a suitable handling tool or pair of pliers, not shown.

Then, to the bracket or support 7 is imparted a movement of translation towards the fixed support or bracket 6 so that the tow shaft sections 2*a*, 2*b* of inner roller 1 be assembled and aligned with each other while the blank 19 is brought to its operative position between the two half-dies 8*a*, 8*b* at the end of this movement of translation.

The outer wheel 12 is then moved for rotation about its axis and shifted bodily with its support 15 towards the inner roller 1 (see arrow 21), so that after a predetermined movement within the radial slot 11 of the die support it engages the peripheral surface of blank 19 and, by pressing this blank against the inner roller 1, rotatably drives it and begins to impress its outer peripheral profile on the outer peripheral contour of the blank. The blank material thus rolled between the wheel 12 and roller 1 will gradually fill up the cavity defining the outer limits of the race, as formed by the pair of half-dies 8*a* and 8*b*, said half-dies being likewise rotatably driven with an increasing torque due to the friction produced between the blank material and the walls of said cavity. When the cavity formed by said half-dies 8*a*, 8*b*, on either side of roller 1, is filled completely, any excess of blank material can flow into an annular leakage space 22 provided between said half-dies and said inner roller, in the limit position of spindle support 15 as defined by the abutment members 16, 17.

It will be seen that during this rolling operation, the spindle support 15 engages the abutment members 18 of die support 10, thus carrying along said die support 10 during its feed movement together with roller 1; in other words, with this arrangement a proper adjustment of abutment members 18 will determine the depth of the impression formed by the outer wheel 12 in the peripheral surface of the completed race, whereas adjusting the abutment member 16 will determine the thickness of said completed race as well as its inner diameter, since its outer diameter is determined by the cavity formed between said half-dies 8*a*, 8*b* and the outer wheel 12. The end position of the rolling operation is illustrated in FIG. 2.

Upon completion of the above-described feed movement of the spindle support 15, the backward movement of this support as well as that of the outer wheel 12 are controlled together with the opening movement of the half-dies, which consists of a movement of translation of the movable support 7 in the opposite direction, this movement being also accomplished by the die guide member 3*b* and half-die 8*b*, and by the shaft section 2*b* carrying the inner roller 1, so that the finished roller race can be removed and another blank can be substituted therefor on said inner roller 1 for a subsequent rolling operation.

For this purpose, the coupling between the half-dies and their lateral guides may result from a simple magnetic pull. This coupling may also be of a mechanical type as illustrated in the case of half-die 8*b* in FIG. 1, wherein three screws 23 having countersunk heads extend through the half-die with a radial clearance greater than the operating stroke contemplated for this half-die, said screws 23 engaging a corresponding lateral guide member 3*b* and pressing said half-die thereagainst with a predetermined holding force assisted by resilient washers 24 interposed between the screw heads and the half-die. In addition, the die support 10 may be urged by suitable and known means (not shown) to its inoperative position for recentering it before opening the half-dies, so that the half-dies be properly re-positioned as illustrated in FIG. 1 at the end of the operation and preliminary to the next operation.

Figure 3:
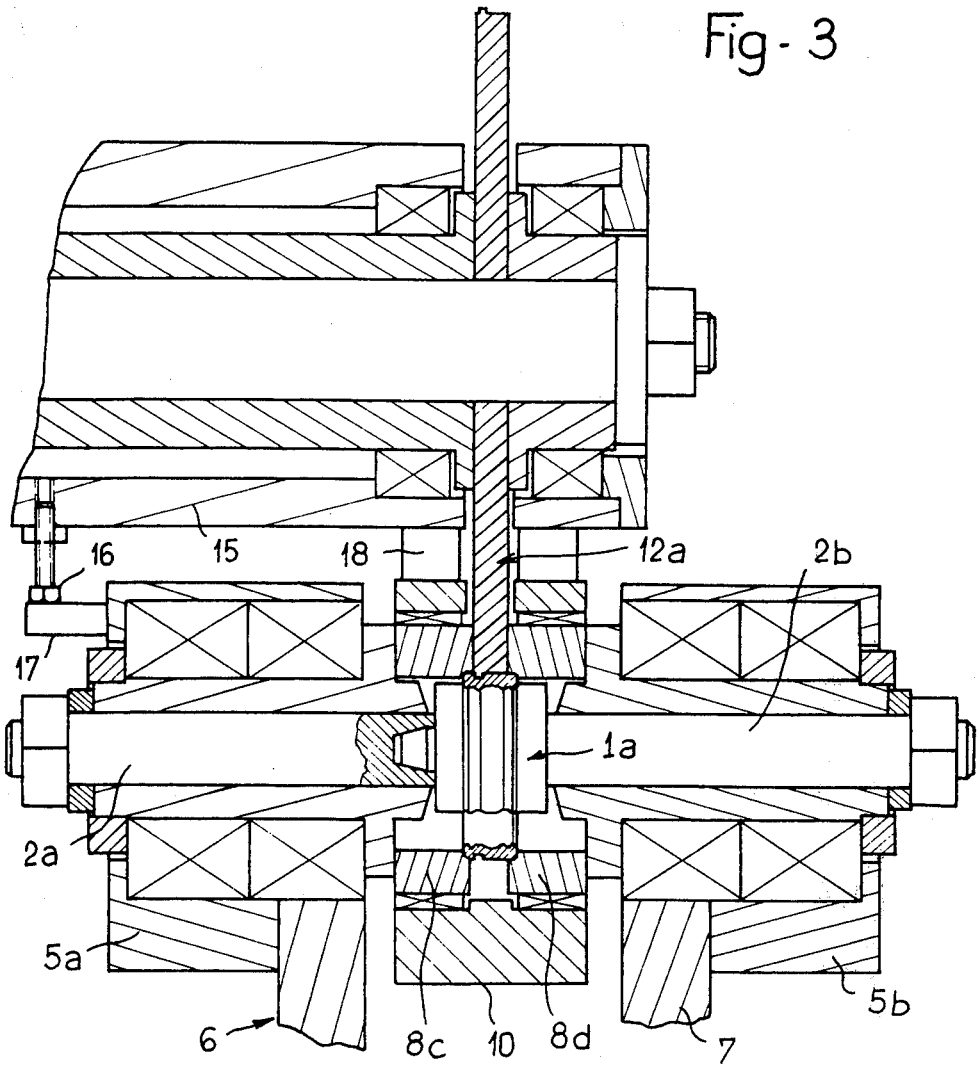
FIG. 3 is an axial section showing a rolling device intended for the manufacture of the outer races of ball-bearings.

FIG. 3 illustrates the application of this device to the rolling of an outer race of a rolling-contact bearing; in this case, the only difference with the preceding structure lies in the type of wheel and roller utilised, i.e. the outer wheel 12*a* and the inner roller 1*a*, and also in the actual shape of the half-dies 8*c*, 8*d*, more particularly in the operative portions thereof, which are selected as a function of the desired impression profiles.

It will also be seen that the rolling operation is accomplished on an inner roller properly supported between two bearings.

Although the above forms of embodiment comprise means for rotatably driving only the outer wheel 12, it will readily occur to those conversant with the art that the inner roller 1 could as well be rotatably driven during the rolling operation, if desired.

Finally, although specific forms of embodiment of this invention have been described hereinabove and illustrated in the accompanying drawing, it will readily occur to those skilled in the art that various modifications and changes may be brought thereto without departing from the scope of the invention as set forth in the appended claims.

What is claimed as new is:

1. Device for rolling rolling-contact bearing races from a blank by means of a die and shaping wheels comprising an inner roller for obtaining the internal profile of the race in the die from which it is separated to permit a possible extrusion of the excess material of said blank, said inner roller being mounted on a shaft rotating in a fixed support in its operative position; an outer wheel having an outer working profile for shaping part of the external profile of the race against the action of the inner roller; said die being divided in the axial direction into two separable sections disposed on either side of said outer wheel in a die support, said die support being mounted for movement across said shaft and being responsive to the thrust from a member supporting said outer wheel during the rolling operation; and said sections constituting a cavity of which the profile is designed for shaping the portions of the outer profile of the race which are adjacent to those shaped by said roller, the two die sections being fitted for free rotation in said die support.

2. Rolling device according to claim 1, wherein said inner roller shaft is divided into two sections adapted to be assembled in end-to-end relationship through matching portions thereof, each shaft section being supported by a bearing on either side of said inner roller, one of said bearings being movable in the axial direction and bodily with the relevant shaft section and die section.

3. Rolling device according to claim 1, wherein the operative distance between said outer wheel and inner roller is adjustable by means of a mechanical abutment member disposed between the shaft support of said inner roller and the support of said outer wheel.

4. Rolling device according to claim 1, wherein the depth of the impression formed by said outer wheel in said race blank is adjustable by means of a mechanical abutment member disposed between said die support and said outer wheel support.

5. Rolling device according to claim 2, wherein at least one portion of the die which is axially movable is coupled to the adjacent shaft section by magnetic pull.

6. Rolling device according to claim 2, wherein at least the axially movable die section is coupled to the adjacent shaft section through screws embedded with an axial play depending on the movement of said die support, with the interposition of resilient means between the heads of said screws and said die section.

* * * * *